US005645690A

United States Patent [19]

Cox, Jr.

[11] Patent Number: 5,645,690

[45] Date of Patent: Jul. 8, 1997

[54] PRESSURE RELIEF SYSTEM FOR TREATING FIBROUS MATERIALS UNDER PRESSURE

[75] Inventor: James P. Cox, Jr., Barlow, Ky.

[73] Assignee: Westvaco Corporation, New York, N.Y.

[21] Appl. No.: 712,359

[22] Filed: Sep. 11, 1996

[51] Int. Cl.[6] ..... D21D 1/00; D21D 1/20

[52] U.S. Cl. ..... 162/261; 162/23; 162/28; 162/234; 241/28; 241/31; 241/244

[58] Field of Search ..... 162/23, 26, 28, 162/68, 234, 235, 236, 261; 241/28, 31, 244

[56] References Cited

U.S. PATENT DOCUMENTS 2,293,670 8/1942 Sickman ..... 83/94

4,221,631 9/1980 Hellerqvist et al. ..... 162/23

4,236,959 12/1980 Reinhall ..... 162/23

*Primary Examiner*—Donald E. Czaja

*Assistant Examiner*—Steven B. Leavitt

[57] ABSTRACT

A process and apparatus is disclosed for treating fibrous material under pressure which includes at least two pressure relief devices. The pressure relief devices are arranged so that only one at a time is exposed to pressure during the treatment process. When the exposed pressure relief device is ruptured in response to an abnormal increase in pressure, the ruptured device may be isolated and the second pressure relief device exposed to the operating pressure so that the treatment apparatus may be operated on a substantially continuous basis.

14 Claims, 4 Drawing Sheets

PRESSURE RELIEF SYSTEM FOR TREATING FIBROUS MATERIALS UNDER PRESSURE

BACKGROUND OF INVENTION

The present invention relates generally to the treatment of materials under pressure, and more particularly, to the refining of fibrous cellulosic materials under conditions which permit the process to be carried out on a substantially continuous basis.

Cellulosic fibers must be subjected to mechanical treatment before they can be made into paper. This treatment may be applied in a number of different ways, but it generally includes a rubbing, distortion or crushing action on the fibers. The terms beating and refining are often used in the paper industry to describe the operation of mechanically treating pulp fibers. Refining usually refers to a fiber separation and fiber cutting action, whereas beating action may include these two effects, and also a fibrillating effect on the fibers. The amount and type of mechanical treatment used on the pulp contributes to the final pulp properties including burst, tensile strength, density, bulk, freeness and formation. In this regard, refining with a disk refiner is an effective treatment for enhancing the properties of paper pulp.

In disk refining, the pulp generally enters the refiner at a solids content of about 4–5%. For this purpose, the refiner housing has an inlet arranged to direct the pulp through an opening near the center of one disk, from which it passes into a central feeding chamber. Centrifugal forces at that point force the pulp outwardly between the disks where the refining action takes place before the treated pulp is discharged at the periphery of the housing. Pulp throughout is controlled by the amount of material introduced into the refiner, while the gap or space between the refiner disks determines the amount of work or energy expended on the pulp.

Because of the water present in and with the pulp which is admitted into the refiner housing, great amounts of steam are generated as energy is added during the refining operation. The build up of steam and pressure in the refiner housing is partially relieved when some of the steam passes out of the refiner space with the treated pulp. Sometimes the steam flowing outward together with the fibrous material assumes a very high speed, however, fiber bundles or discontinuities produced during refining may plug the refiner and obstruct the flow through the refiner outlet, thus producing an abnormal amount of pressure in the refiner housing. Under these conditions, safeguards must be provided to alleviate the high pressures. In many cases, the refiner may need to be shut down for correcting the problem that caused the high pressures. However, often the refiner can be continued in service by temporarily relieving the excess pressure.

An example of a means for relieving steam pressure in a refiner is disclosed in U.S. Pat. No. 4,221,631. In this patent, passageways are provided in each of the refining surfaces of the refining disks so that the steam generated during refining may be withdrawn without also withdrawing substantial quantities of unrefined fibrous material. Meanwhile, in U.S. Pat. No. 4,236,959, the discharge of refined material is controlled by an exhaust valve capable of adjusting the size of the outlet in response to signals from a regulator connected to a pressure sensing instrument located in the refiner housing. Also, in U.S. Pat. No. 2,293,670, there is disclosed a refiner apparatus which includes a rupturable diaphragm in the conduit for venting the combustion products of fires that might occur during refining. In this connection, it is also known to install a pressure relief means in the form of a rupturable disk in association with the outlet of a refining device which is designed to rupture and relieve pressure in the refiner when abnormally high pressures are reached. However, when only a single rupture disk is included in the discharge conduit of a refiner, the refiner must be shut down in order to replace the rupture disk when a disruption occurs. This is a decided disadvantage when it is desired to keep the refiner operating on a substantially continuous basis.

SUMMARY OF INVENTION

The present invention is designed to take advantage of the use of a rupture disk type pressure relief system in the discharge outlet of a mechanical device which operates under high pressures, but with the added feature of arranging the rupture disk system so that the mechanical device can be operated in a substantially continuous manner despite any disruptions due to the occurrence of abnormally high pressures in the mechanical device.

In the preferred process of the present invention, pulp having a solids content of from about 75–85% is fed on a continuous basis into and through a work space formed between the opposed, spaced apart working elements of a disk refiner. The working elements, or refiner disks, include opposed surfaces which apply forces to the pulp to effect fiber separation and cutting action. During the treatment, the moisture in the pulp is converted into steam under pressure, and produces conditions where fiber bundles or the like may become trapped in the refining space to produce abnormally high pressures. It is desirable under these conditions to provide pressure relief devices in association with the refiner device or the discharge outlet for relieving the excess pressure.

In order to relieve the above noted condition while providing means for maintaining the substantially continuous operation of the refiner device, the present invention provides a pressure relief system which includes at least two pressure relief devices and a means for exposing only one pressure relief device at a time to the pressure existing in the discharge conduit. This arrangement results in a situation where the flow of treated material from the discharge conduit of the refiner may be kept on a substantially continuous basis when the exposed pressure relief device ruptures. For example, upon the rupture of the first pressure relief device, the flow of treated material from the refiner may be diverted so as to flow past the second pressure relief device. Meanwhile, the first pressure relief device can be isolated and repaired so as to be available in the event of a second pressure increase which might rupture the now exposed second pressure relief device. In the event that the rupture of the first pressure relief device does not adequately relieve the pressure in the refiner, the refiner may need to be shut down temporarily for cleaning or removal of any obstructions that might have caused the increased pressure, but upon tending to this correction, the refiner may be started again immediately with the resumed flow being conducted past the second pressure relief device, and the first pressure relief device may be repaired.

The present invention is particularly effective with the use of rupture disks as the pressure relief devices. Such devices are available from Continental Disc Corporation, Liberty, Mo., in particular Model No. 252507, having a designed rupture pressure on the order of about 119 psig at 72 degrees F. It will also be understood that the present invention may be adapted to other mechanical devices which operate under pressure and which are subject to abnormally high pressure spikes which may need to be relieved.

The drawing and detailed description which follow set forth several embodiments for carrying out the present invention.

DETAILED DESCRIPTION

Figure 1:
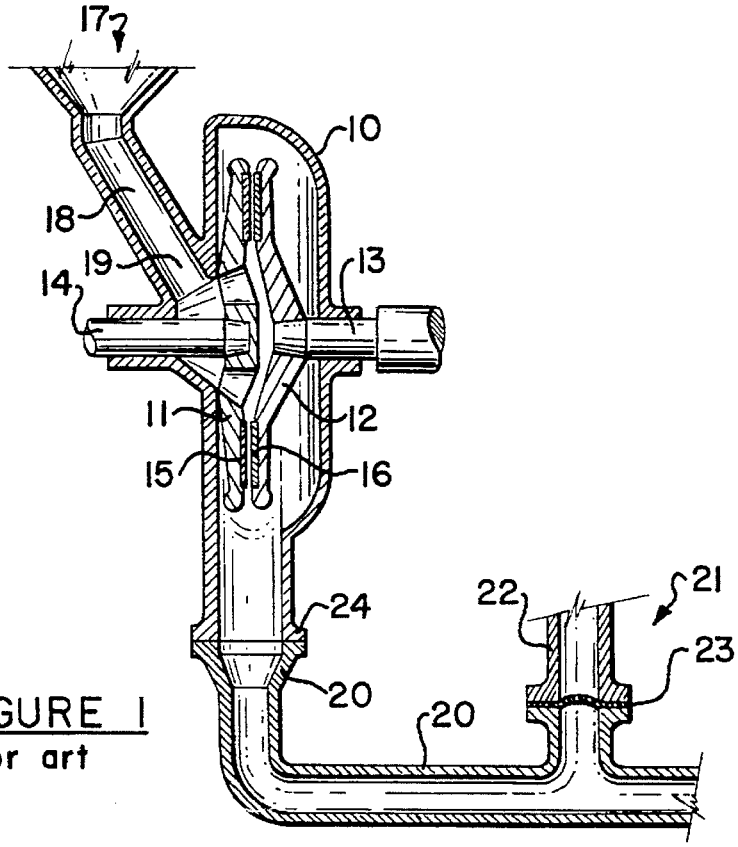
FIGURE 1 prior art
FIG. 1 is a view in cross section showing a typical prior art refiner device having a single rupture disk associated with the discharge outlet.

The basic concept of the present invention is illustrated schematically in the drawings. FIG. 1 shows a typical prior art refiner device including a housing 10, a pulp receiving hopper 17 and a pulp feeding passage 18. Within the housing 10 is a feed chamber 19 located near the center of the refiner which serves as a distribution point for pulp entering the work space between a stationary disk 11 mounted on shaft 14, and a rotatable disk 12 mounted on shaft 13. Meanwhile, the working faces of the disks 11, 12 are provided with annular plates 15, 16 between which the pulp fibers pass during refining. Thus, as the pulp is constrained to move outwardly between the plates 15, 16, the action of disk 12 rotating opposite disk 11 produces a rapid rolling of the fiber bundles and a separation of the fibers under the influence of centrifugal force. As a result of the pressure and gravity influences in the refiner 10, the separated fibers are discharged radially from between the plates 15, 16 and into the discharge conduit 20 of the refiner.

However, experience has shown that during this process, the moisture in the pulp is converted into steam and considerable pressure builds up in the refiner housing 10 due to the work being done on the fibers. It has also been found that sometimes fibers become trapped between the ends of the disks 11, 12 and the inner wall of the refiner housing 10. When this occurs, the fibers receive more work, heat, and pressure than normal, and as a consequence the pressure in the refiner becomes abnormally high. For a number of reasons, e.g. consistency increases or refiner loading, the result may be a high pressure spike in the refiner that must be addressed.

It is known, on the other hand, to include a rupturable diaphragm in the outlet conduit of a refiner, particularly as disclosed in U.S. Pat. No. 2,293,670, for the purpose of venting the combustion products of any fires that might occur during refining. In addition, it is also known to include a single rupture disk in association with the discharge conduit of a refiner device. An example of such an arrangement is shown schematically in FIG. 1 hereof, identified as "Prior Art". Note for this purpose, a rupture disk installation 21 associated with the discharge conduit 20 which is capable of rupturing in response to any abnormally high pressure in the refiner housing 10. For this purpose, a separate conduit 22 is joined to discharge conduit 20 by any conventional means, and a rupture disk 23, as for example a Model No. 252507, supplied by Continental Disc Corporation is incorporated into the separate conduit 22. In the operation of the typical prior art refiner shown in FIG. 1, when the pressure in the refiner housing 10 becomes abnormally high, the disk 23 ruptures and relieves pressure. However, upon the occurrence of a rupture, the flow through the discharge outlet 20 can escape through conduit 22 and the refiner must be shut down to replace the disk 23. This results in a delay in the operation of the process and interrupts the continuous operation of the refiner.

In order to overcome this deficiency, it is proposed according to the present invention to include at least two pressure relief devices in association with the discharge conduit in conjunction with a means for exposing first one and then the other of the pressure relief devices to the pressure in the discharge conduit. Thus when the first pressure relief device exposed to pressure ruptures, the ruptured device may be isolated for repair while the substantially continuous flow of treated material from the refiner may be resumed by diverting the flow past the second intact pressure relief device. The preferred pressure relief device utilized in the present invention is a rupture disk designed for the intended use and an arrangement of valves and separate conduits as needed to carryout the intent of the invention.

Figure 2:
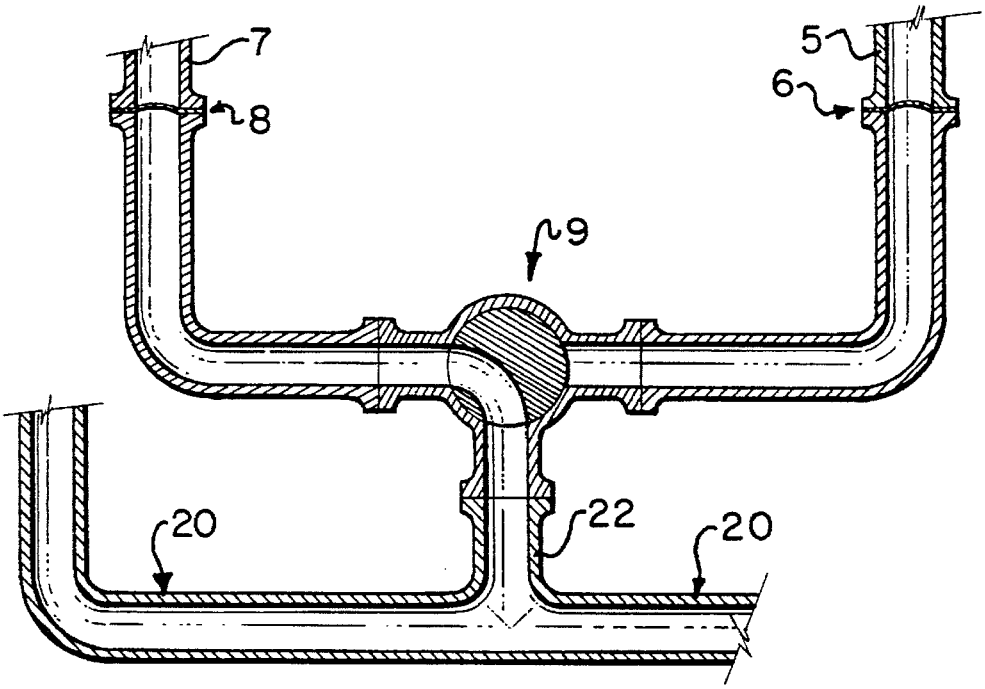
FIG. 2 is a view as in FIG. 1 showing a first embodiment of the present invention with two rupture disks.
Figure 3:
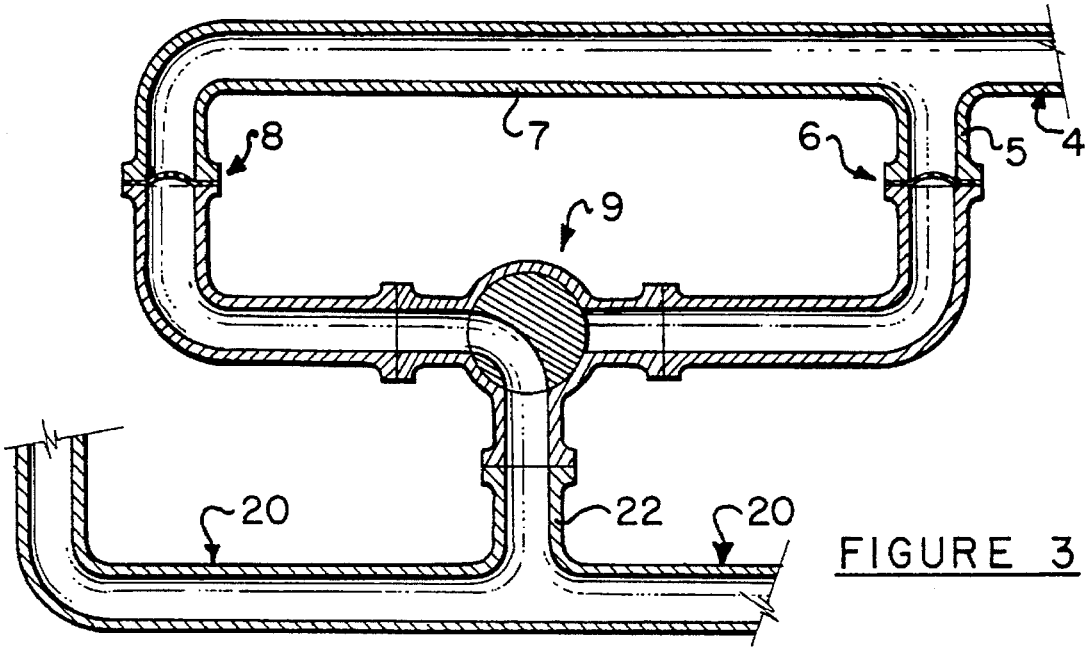
FIG. 3 illustrates a second embodiment of the present invention.

FIG. 2 illustrates a first example of an arrangement suitable for carrying out the present invention. As shown in FIG. 2, a valve 9 is located in a separate conduit 22 attached to discharge conduit 20. Valve 9 is preferably of the three-way, three port type meaning it has three ports through which material may be directed. In the version shown in FIG. 2, the valve 9 includes a ball which, in the position shown, exposes rupture disk 8 in conduit 7 to the pressure in discharge conduit 20. Under any abnormal condition in the refiner device which produces a pressure increase sufficient to rupture disk 8, the ball of valve 9 may be turned to isolate disk 8 and expose rupture disk 6 in conduit 5 to the pressure in discharge conduit 20. In this manner, the refiner device may be kept in substantially continuous operation while the ruptured disk 8 is repaired. FIG. 3 illustrates an embodiment substantially like FIG. 2 with the only difference being that conduits 5 and 7 are interconnected to produce only a single separate discharge conduit 4 for any refined material that escapes past rupture disk 6 or 8.

Figure 4:
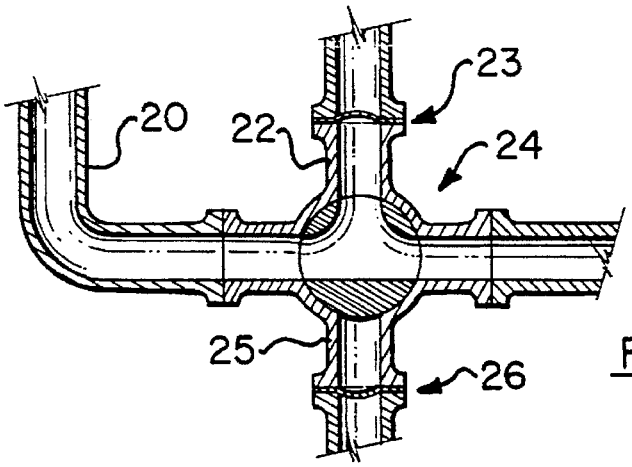
FIGS. 4–8 illustrate alternative arrangements for incorporating two rupture disks in the discharge conduit of a typical mechanical device which operates under pressure.

In FIG. 4, the flow from the refiner housing through discharge conduit 20 passes directly through a valve 24 located in the discharge conduit 20. Valve 24 is preferably of the four-way, four port type, meaning it has four ports (an inlet port, an outlet port, and two adjacent ports), with the adjacent ports connected to separate conduits 22 and 25. In the version shown, the valve 24 includes a ball which permits flow straight through the valve between the two opposed inlet and outlet ports, and at right angles to the straight through passageway towards one or the other of the two adjacent ports connected to conduits 22 and 25. Each of the separate conduits 22, 25 attached to the two adjacent ports, includes a rupture disk 23, 26. In a first position of the ball of valve 24, the flow of refined material from discharge outlet 20 continues straight through the valve between the inlet and outlet ports, and by virtue of the right angle passageway, the pressure in discharge conduit 20 is also exposed to separate conduit 22 and rupture disk 23. Under any abnormal condition in the refiner device which produces an increase in pressure above the design specification for rupture disk 23, the rupture disk will burst and relieve the pressure. In such case, the flow of material from discharge conduit 20 may leak from conduit 22. However, as soon as the condition which caused the disruption is resolved, the ball of valve 24 may be adjusted immediately to isolate conduit 22 and the ruptured disk 23 from the pressure in conduit 20, and at the same time, expose conduit 25 to the pressure in discharge conduit 20, which exposes rupture disk 26, thus allowing the substantially continuous operation of the refiner while the blown rupture disk 23 is repaired for future availability.

Figure 5:
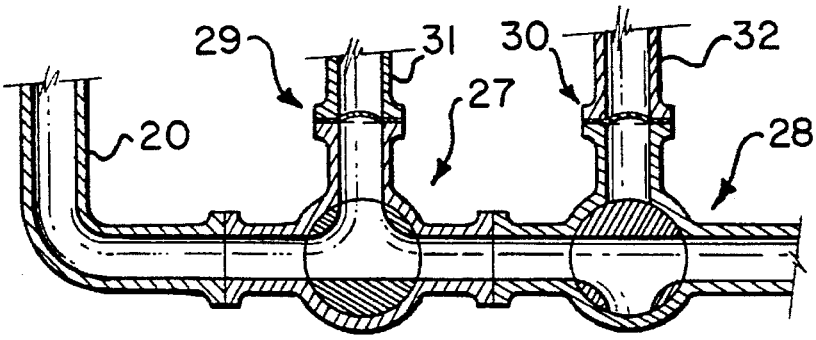

FIG. 5 illustrates an alternative arrangement for carrying out the present invention wherein a pair of three-way, three port ball valves 27, 28 are arranged in-line within the discharge conduit 20. Rupture disks 29, 30 are located in separate conduits 31, 32 that are connected with each valve 27, 28 respectively. In a first operating condition, the ball of valve 27 is adjusted to permit flow straight through the valve while exposing the rupture disk 29 in conduit 31 to the pressure in the refiner. Upon the rupture of disk 29 because of some abnormally high pressure condition, valve 27 may be closed to isolate the blown disk 29, and the ball in valve 28 adjusted to expose the rupture disk 30 in conduit 32 to the flow in discharge conduit 20, thus permitting the substantially continuous operation of the refiner while the blown rupture disk 29 is repaired.

Figure 6:
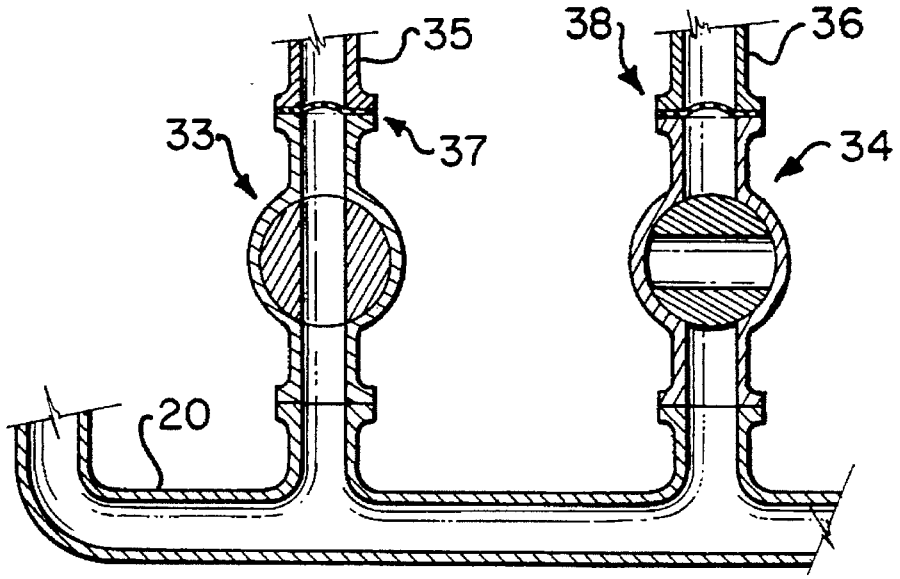

FIG. 6 illustrates another single discharge conduit arrangement wherein a pair of two-way, two port ball valves 33, 34 are located in separate conduits 35, 36 connected to discharge conduit 20. Each conduit 35, 36 is provided with a rupture disk 37, 38. In a first operating condition, the ball of valve 33 is adjusted to expose the rupture disk 37 to the pressure in discharge conduit 20 while valve 34 is adjusted to isolate rupture disk 38 from the pressure. Upon rupture of disk 37, the positions of the balls in valves 33, 34 may be reversed to expose rupture disk 38 to the pressure in discharge conduit 20 and to isolate the ruptured disk 37, for substantially continuous operation of the refiner.

Figure 7:
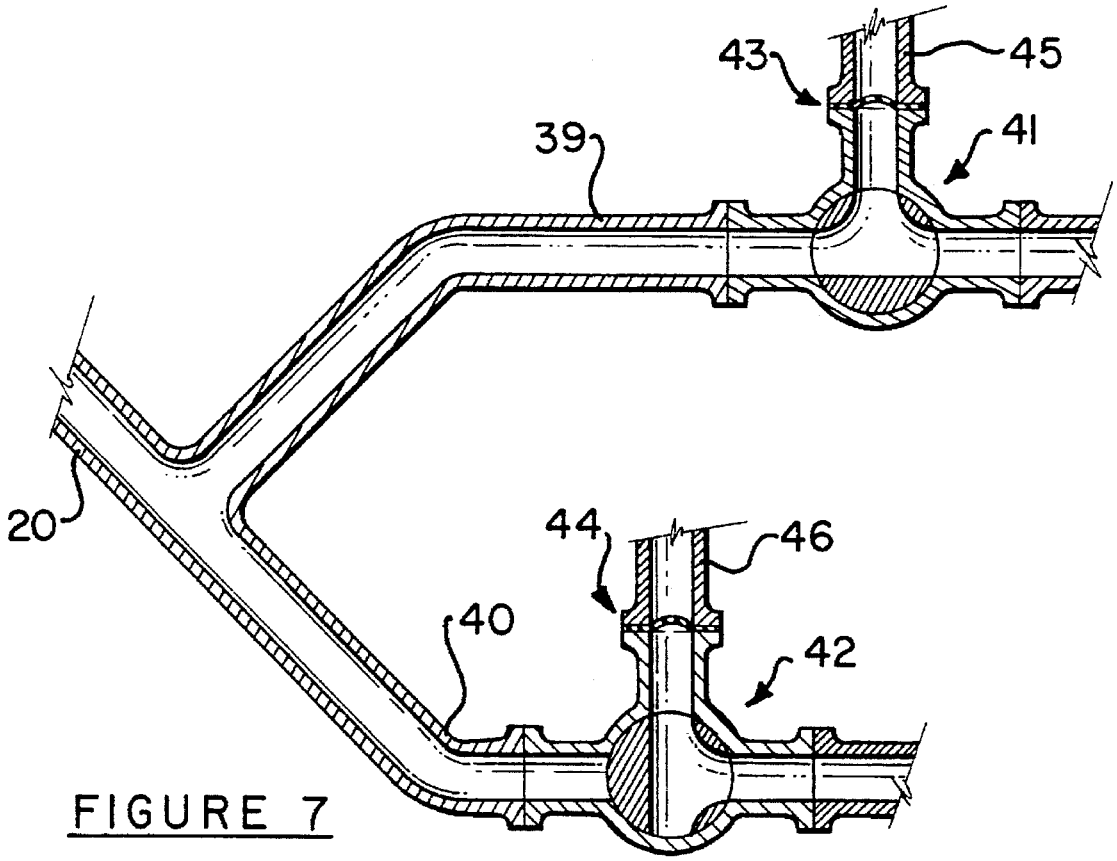
Figure 8:
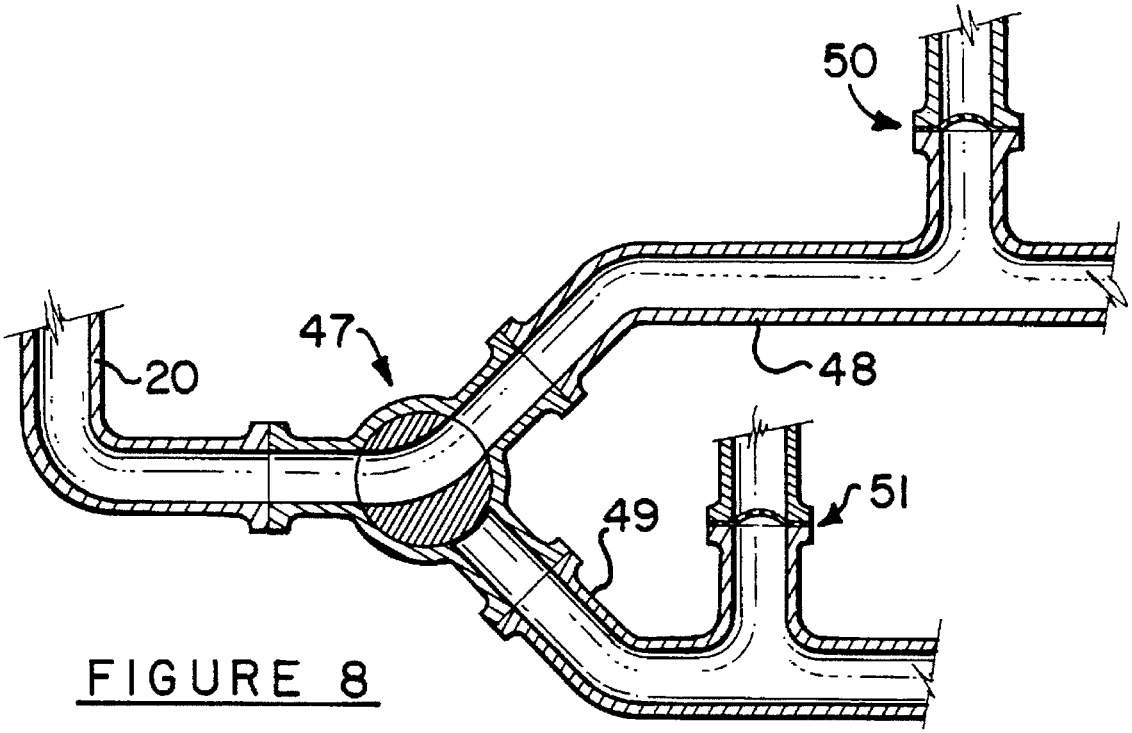

FIGS. 7 and 8 illustrate typical arrangements for the pressure relief system of the present invention where the discharge conduit may be split into two separate outlets. In FIG. 7, discharge conduit 20 is divided into two separate outlets 39 and 40. Each of these separate outlets may be provided with in line three-way, three port valves 41, 42 leading to separate conduits 45, 46 associated with rupture disks 43, 44. As shown in FIG. 8 a single ball value 47 may be installed at the intersection between discharge conduit 20 and the separate outlets 48, 49. The valve 46 is arranged to direct the flow from discharge conduit 20 into one or the other of separate outlets 48, 49. Each separate conduit is provided with a rupture disk 50, 51 so that upon the rupture of the first exposed disk 50 or 51, the valve 47 may be adjusted to direct the flow through the other separate outlet having the intact rupture disk. In each case, the objective is to isolate the first ruptured disk and to divert the flow past the second intact rupture disk for substantially continuous operation of the refiner device.

It may be seen that the present invention offers a simple and effective means for relieving the sometimes dangerous pressure build up in a mechanical device such as a pulp refiner while providing a novel means for keeping the device operating in a substantially continuous manner. Moreover, while the invention has been described with several embodiments it will be understood that other methods for accomplishing the same results will be apparent to those skilled in the art. Accordingly the invention should be measured only by the scope of the appended claims.

What is claimed is:

1. Apparatus for refining fibrous material in a pressurized refining device which comprises at least one pair of refining disks located in a refiner housing and mounted for relative rotation with respect to one another, said refining disks including inner refining surfaces which define a refining space therebetween through which the fibrous material passes during refining, an inlet conduit for feeding fibrous material into said housing for refining, and a discharge conduit for removing the refined fibrous material from said housing, the improvement wherein at least two pressure relief devices are provided in communication with said discharge conduit and a means is provided for exposing only one pressure relief device at a time to the pressure in said discharge conduit said means actuated when an increase in the pressure within the discharge conduit is sufficient to cause a failure of one of the pressure relief devices.

2. The apparatus of claim 1 wherein the pressure relief devices comprise rupture disks which are adapted to rupture and relieve pressure in the refining device at specified pressures.

3. The apparatus of claim 2 wherein the rupture disks are located in separate conduits in communication with said discharge conduit and the means for exposing only one rupture disk at a time to the pressure in said discharge conduit comprises a four way, four port valve arranged in-line with said discharge outlet.

4. The apparatus of claim 2 wherein the rupture disks are located in separate conduits in communication with said discharge conduit and the means for exposing only one rupture disk at a time to the pressure in said discharge conduit comprises a single three-way, three port valve located in a connector conduit which connects said discharge conduit to said separate conduits.

5. The apparatus of claim 2 wherein the rupture disks are located in separate conduits in communication with said discharge conduit and the means for exposing only one rupture disk at a time to the pressure in said outlet conduit comprises a pair of three-way, three port valves arranged in-line with the discharge conduit each connected to a separate conduit.

6. The apparatus of claim 2 wherein the rupture disks are located in separate conduits in communication with said discharge conduit and the means for exposing only one rupture disk at a time to the pressure in said discharge conduit comprises a pair of two-way, two port valves, one located in each separate conduit between the rupture disks and the discharge conduit.

7. The apparatus of claim 2 wherein the discharge conduit is split into two independent outlets and the rupture disks are located in separate conduits, one in communication with each independent outlet, and the means for exposing first one and then the other of said rupture disks to the pressure in discharge conduit comprises a pair of three-way, three port valves, one located in-line with each independent outlet between its respective rupture disk and discharge conduit.

8. The apparatus of claim 2 wherein the discharge conduit is split into two independent outlets and the rupture disks are located in separate conduits, one in communication with each independent outlet, and the means for exposing first one and then the other of said rupture disks to the pressure in the discharge conduit comprises a single, in-line, three-way, three port valve adapted to be activated to direct flow from the discharge conduit through one or the other of said independent outlets.

9. In a mechanical device for treating a fibrous material under pressure, said mechanical device including a discharge conduit for conducting treated fibrous material away from said mechanical device, a pressure relief system in communication with said discharge conduit which permits the mechanical device to operate on a substantially continuous basis despite increases in the pressure in said mechanical device, said pressure relief system comprising at least two rupturable pressure release devices in communication with said discharge conduit and a means for exposing only one pressure release device at a time to the pressure in the discharge conduit so that, upon an increase in pressure in the discharge conduit sufficient to rupture the first pressure release device, the first pressure release device may be isolated from the discharge conduit and the second pressure release device may be exposed to the discharge conduit to maintain the substantially continuous operation of the mechanical device.

10. The method for treating fibrous material under pressure in a mechanical device and for discharging the treated fibrous material from the mechanical device on a substantially continuous basis comprising the steps:

(a) providing a mechanical device for treating the fibrous material;

(b) providing an inlet conduit for feeding material to be treated into the mechanical device;

(c) providing a discharge conduit for conducting the treated material away from the mechanical device;

(d) providing at least two rupturable pressure relief devices in communication with the discharge conduit of step (c);

(e) providing a valve means for exposing only one pressure relief device at a time to the pressure in the discharge conduit of step (c); and, (f) actuating the valve means of step (e) to switch from a first pressure relief device to a second pressure relief device upon an increase in the pressure in the discharge conduit sufficient to rupture the first pressure relief device, so that the first pressure relief device may be isolated from the discharge conduit and the second pressure relief device may be exposed to the pressure in the discharge conduit to maintain the substantially continuous operation of the mechanical device.

11. The method of claim 10 wherein the mechanical device is a pulp refiner and the treated fibrous material is a lignocellulosic containing fibrous material.

12. The method of claim 11 wherein the pressure relief devices are rupture disks which rupture and relieve excess pressure in the mechanical device at designated pressures.

13. The method of claim 12 wherein the rupture disks are located in separate conduits in communication with the discharge conduit and the valve means for exposing only one rupture disk at a time to the pressure in the discharge conduit comprises a four-way, four port ball valve.

14. The method of claim 12 wherein the rupture disks are located in separate conduits in communication with the discharge conduit and the means for exposing only one rupture disk at a time to the pressure in the discharge conduit comprises one or more ball valves associated with said discharge conduit.

* * * * *